United States Patent [19]

Springston et al.

[11] 4,012,017

[45] Mar. 15, 1977

[54] ROTARY KITE

[76] Inventors: Lyle William Springston, 1011 W. Raven Road, Peoria, Ill. 61614; Richard Lyle Springston, 1014 Main St., Peoria, Ill. 61606

[22] Filed: June 8, 1976

[21] Appl. No.: 693,742

[52] U.S. Cl. ..... 244/153 A

[51] Int. Cl.[2] ..... B64C 31/06

[58] Field of Search ..... 244/153 R, 153 A, 39, 244/154; D34/15 AF

[56] References Cited

UNITED STATES PATENTS

| | | | |
|---|---|---|---|
| 1,051,659 | 1/1913 | Ames | 244/154 |
| 3,079,115 | 2/1963 | Edwards et al. | 244/153 A |

FOREIGN PATENTS OR APPLICATIONS

| | | | |
|---|---|---|---|
| 953,276 | 3/1964 | United Kingdom | 244/153 A |

*Primary Examiner*—Trygve M. Blix
*Assistant Examiner*—Barry L. Kelmachter

[57] ABSTRACT

A rotary kite consisting of a single elongated airfoil element or wing with two perpendicularly attached circular stabilizer elements positioned on the airfoil so as to enclose a central longitudinal quarter of the airfoil element. Each stabilizer disk has an elongated S-shaped slot centered upon its surface through which the wing is inserted thereby causing a wing cross-section to have an S-shaped configuration. A dowel-type shaft is centered laterally on one side of the airfoil element and serves as an axis of rotation for the airfoil and its two stabilizer disks. Multiple bracing lines interconnect both disks and each line further extends to both ends of the shaft thus holding the two disks semi-rigid and perpendicular to the airfoil. A nail at each end of the dowel secures a plastic bearing to which a bridle line is attached and the unattached line ends are joined to form a V-shaped bridle. The revolving motion of the airfoil is sustained by the air movement into the airfoil's upper half forcing that half forward and downward bringing the convex lower section upward and into the concave upper position in place for the next half-revolution.

1 Claim, 3 Drawing Figures

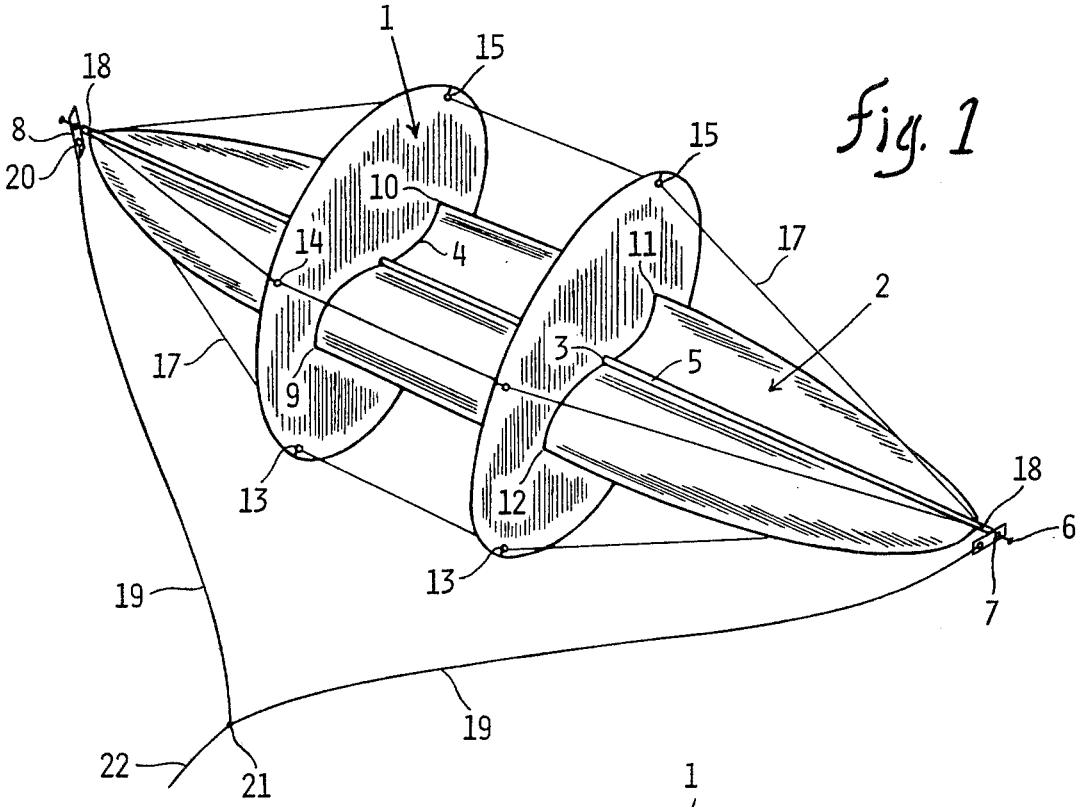
Fig. 1
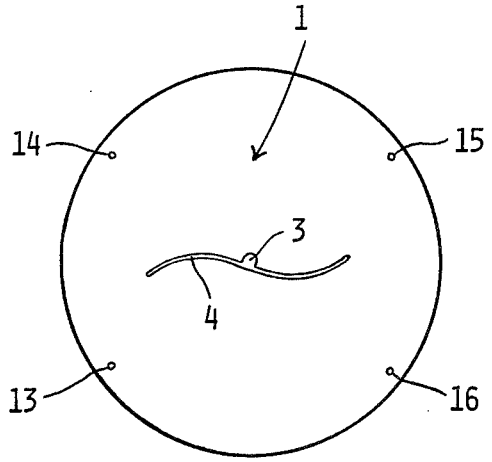
Fig. 2
Fig. 3
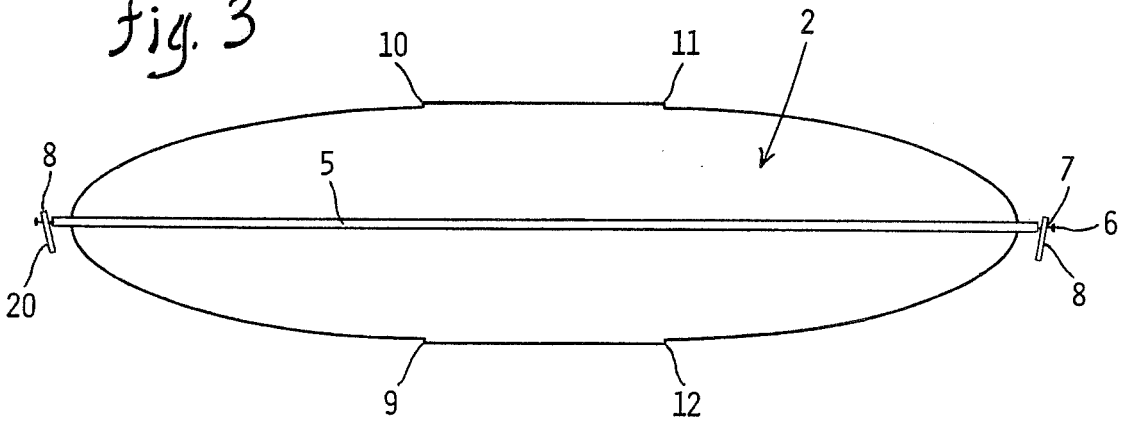

ROTARY KITE

BACKGROUND OF THE INVENTION

Rotating airfoil or mechanical kites have existed in various forms for many years. They are unique among kites because a wind powered rotary motion of the kite is a necessary and integral part of its flight. When the relative air movement is of sufficient velocity to provide lift to the kite equal to its weight, it will rise and rotate on a central axis and continue this rotating motion throughout its flight. Despite this novel and unusual difference, the rotary kite has remained little known, difficult to obtain, and has accounted for only a small percentage of the kite market.

An important characteristic of any kite is stability, the ability to acquire and maintain altitude, without diving, throughout an acceptable wind velocity range. Rotary kites, priced generally at eight times or more those kites at the economy end of the market, have, by comparison, lacked a desirable amount of stability, an important consideration in the marketability of a higher priced kite.

SUMMARY OF THE INVENTION

It is an object of our invention to provide a significantly more stable rotary kite capable of attaining altitudes and flight durations superior to others of previous design. This improvement is accomplished by employing lightweight dual stabilizer elements which provide a greater stabilizer area-to-weight ratio than heretofore found in rotary kites. Also employed is the coordinated use of a unique stabilizer bracing system, described herein, which provides a high degree of rigidity, strength, and durability to the kite's stabilizer element.

More particularly, it is the object of this invention to utilize the stabilizer element in its most beneficial way; first, by employing the maximum amount of stabilizer area possible through the use of extremely lightweight stabilizer material reinforced by stabilizer bracing line; and second, the placement of two stabilizer disks in a particular way along the airfoil thereby giving the airfoil element both increased and evenly distributed support and stabilization. Our kite's stabilizer element is used to provide strength to the airfoil element thus avoiding weight of airfoil strengtheners or heavier airfoil materials. Flight at lower wind speeds is facilitated by reducing the kite's weight to a minimum. The utilization of a proportionately large stabilizer element surface area, specially reinforced, improves the kite's stability at higher wind speeds. The dual stabilizer elements used in our invention, reinforced by the bracing line attached to them, are designed to permanently hold their position perpendicular to the airfoil's surface in order to maintain optimal stability and flying performance.

Further, our invention is intended to make possible a greater acceptance of and popularity in rotating airfoil kites by providing a rotary kite of improved design, capable of mass production in kit form at reasonable cost, possessing both durability and flying performance commensurate with its cost.

BRIEF DESCRIPTION OF THE DRAWING

Included in these specifications are accompanying drawings wherein:

FIG. 1 is a perspective view showing the kite as it would appear fully assembled and in flight;

FIG. 2 is an end view of one of two stabilizer disks. A hole is centered within each stabilizer disk and adjacent to the hole is an elongated S-shaped slot, both of which accommodate the passage, respectively, of a shaft and airfoil. Shown around the perimeter of the disk are four holes through which bracing line is inserted and fastened.

FIG. 3 is a view of the airfoil or wing section in its flattened shape with a dowel-type shaft centered laterally and affixed longitudinally to one side of the airfoil's surface and serves as an axle for rotation of the kite. A bearing is secured with a small nail at each end of the dowel.

To be launched and flown the kite is positioned horizontally to the ground and facing into the wind with the concave half of the airfoil upward, as illustrated in FIG. 1, and the convex half below. The air movement into the concave top half causes the airfoil to revolve backward and downward thus bringing the lower half of the airfoil forward and upward. In the interval during rotation when the surface of the airfoil is in a nearly horizontal plane with the ground, the downturned windward edge of the airfoil receives lift similar to that of an airplane wing and vertical lift is created. The aerodynamics of this rotary kite causes it to assume an approximate 45° flight angle.

DESCRIPTION OF THE PREFERRED EMBODIMENT

The following is a more detailed description of the invention wherein:

FIG. 2 shows an end view of one of two stabilizer disks 1, constructed of medium weight cover stock paper having a weight per square inch about one and one half times that of the wind element paper, circular in shape and each disk having a diameter equal to approximately 40% of the airfoil's length. A hole 3, the same diameter as the center axle, is centered in each disk and an elongated S-shaped slot 4 is situated with its midpoint adjacent to the hole. The S-slot spans a straight line distance across the disk equal to approximately 56% of the diameter of the disk leaving about 22% of the disk's diameter at either end of the slot.

FIG. 3 shows the airfoil element 2 lying in a flattened preassembled condition and is constructed of lightweight bristol or other material of similar weight, strength, and rigidity. It is elongated in shape and rounded on both ends. A wooden dowel 5 is centered laterally and secured lengthwise with glue along the center axis of the airfoil and extends about 2% of the airfoil's length beyond each of the airfoil ends. A nail 6 is inserted through a hole 7 in a thin rectangular plastic bearing 8 and secures a bearing at each end of the dowel to allow rotation. Four points 9-10-11-12 locate the four offset corners of the center quarter section of the airfoil and these points serve as a means of positioning the two stabilizer disks at their proper locations after they have been slipped onto the wing, one from each end, during assembly of the kite. The airfoil element 2, upon being placed through the slot 4, forms to the curve of the S-shaped slot along the place the disk and airfoil are in contact. The airfoil assumes this same curvature on all its surface between the two stabilizer disks. The curve of the wing from each stabilizer disk to the nearest wind end, however, tapers off to a lesser degree. Both disks are affixed with glue onto the airfoil element, perpendicular to it and its axle, with the two disks now spaced a distance apart equal to approximately 25% of the airfoil's overall length.

Near the perimeter of each stabilizer disk are four small holes 13-14-15-16 (FIGS. 1 and 2) strategically placed and through which bracing line 17 (FIG. 1) of lightweight nylon line, or similar material, is inserted, looped, and secured with tape or glue at those four points and the line ends then tied off and glued near each end 18 of the axle which serve as anchor points for theline. Securing the stabilizer disks in this manner prevents most lateral movement of them while the flight, regardless of wind conditions, and also reduces damage during periods of handling and storage.

Filament tape (a reinforced tape) one half inch wide is placed on portions of the airfoil's surface to strengthen certain stress points and prevent or retard tearing of the airfoil which would otherwise occur when flying in higher wind velocities. Filament tape is also placed around the edge of each stabilizer disk at four places 13-14-15-16 (Fig. 1), both under and then over the bracing line, to permanently secure the line at these eight points on the two disks.

Bridle line 19 (FIG. 1) is tied through a second hole 20 in each bearing and the two bridle lines, equal in length and each about one and one half times the length of the kite, are brought together at their ends 21 and fastened to a kiteline 22.

All percentage figures given in the preceding description will apply to similar type rotary kites of any dimension.

We claim:

1. A rotary kite consisting of a single elongated airfoil element rounded at each end, a dowel-type shaft extending from slightly beyond one end of said airfoil element to slightly beyond the other end of said airfoil element, said shaft being mounted upon only one surface of said airfoil element and being centered upon said surface, a pair of circular stabilizer disks mounted on said airfoil element, each disk containing an opening at the center of the disk for passage of said shaft therethrough and an elongated S-shaped slot to accommodate passage of said airfoil element therethrough thereby causing the airfoil element to form a concave shape on one side of the shaft and a convex shape on the other side of the shaft, and a plurality of lines attached at specific locations on each disk for interconnecting one of said pair of disks with the other of said pair of disks and for anchoring the disks to both ends of said shaft.

* * * * *